US006179552B1

(12) United States Patent
Jacobsson

(10) Patent No.: US 6,179,552 B1
(45) **Date of Patent: *Jan. 30, 2001**

(54) SPEED CONTROL UNIT FOR A PNEUMATIC ROTATION MOTOR

(75) Inventor: Rolf Alexis Jacobsson, Saltsjö-Boo (SE)

(73) Assignee: Atlas Copco Tools AB, Nacka (SE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/276,236

(22) Filed: Mar. 25, 1999

(30) Foreign Application Priority Data

Mar. 27, 1998 (SE) ..... 9801080

(51) Int. Cl.[7] ..... F01B 25/00

(52) U.S. Cl. ..... 415/25; 415/41; 415/42; 415/904; 137/50; 137/53; 137/57

(58) Field of Search ..... 415/25, 30, 36, 415/41, 42, 44, 904, 202; 137/50, 53, 56, 57; 418/40, 41, 42, 43, 44

(56) References Cited

U.S. PATENT DOCUMENTS

| | | | | |
|---|---|---|---|---|
| 2,485,514 | | 10/1949 | Sturrock . | |
| 2,779,582 | * | 1/1957 | Hopper et al. | 415/36 |
| 3,043,273 | * | 7/1962 | Schott | 418/43 |
| 3,071,115 | | 1/1963 | Schott . | |
| 3,410,030 | * | 11/1968 | McHenry | 418/43 |
| 3,708,240 | | 1/1973 | Theis, Jr. et al. . | |
| 3,749,530 | * | 7/1973 | Amador | 418/41 |
| 3,923,429 | * | 12/1975 | Schaedler et al. | 418/43 |
| 3,930,764 | * | 1/1976 | Curtiss | 418/43 |
| 4,465,443 | * | 8/1984 | Karden | 418/43 |

* cited by examiner

*Primary Examiner*—Edward K. Look
*Assistant Examiner*—Ninh Nguyen
(74) *Attorney, Agent, or Firm*—Frishauf, Holtz, Goodman, Langer & Chick, P.C.

(57) ABSTRACT

A speed control unit for a pneumatic rotation motor having a stator (10) with an air inlet passage (14), a rotor (11) journalled in the stator (10). The speed control unit includes a speed governor (26) operated by two or more fly-weight members (28), and an overspeed safety device (27). The rotor (11) is formed with a coaxial blind bore (22) in which is secured a mounting structure (23) for supporting the fly-weight members (28), the valve element (29) and the bias spring (35) of the speed governor (26) inside the rotor (11). The overspeed safety device (27) includes a flow restricting element (39) displaceably guided in the air inlet passage (14) and locked in an inactive rest position by a trip element (43), and a speed responsive actuator (45) that is co-rotative with the rotor (11). The speed responsive actuator (45) may be formed by an elastically deformable spring element (44) secured to the speed governor valve element (29) and arranged to be radially bent by centrifugal action to hit and release the trip element (43) to thereby free the flow restricting element (39) at the attainment of a predetermined speed level.

16 Claims, 2 Drawing Sheets

SPEED CONTROL UNIT FOR A PNEUMATIC ROTATION MOTOR

BACKGROUND OF THE INVENTION

This invention relates to speed control unit for controlling the speed of a pneumatic rotation motor. In particular, the invention concerns a speed control unit that includes a speed governor and an overspeed safety device for a pneumatic rotation motor having a stator with an air inlet passage and a rotor journalled in the stator.

One problem inherent in prior art speed control units including speed governors, for instance of the type described in U.S. Pat. No. 2,485,514, is that they are located at one end of the motor and, therefore, they add to the length of the motor. This previously known type of speed governor is also exposed to particles of all kinds entering the machine housing by the supplied pressure air. This means that this type of speed governor easily gets contaminated by foreign material and loses its ability to operate as intended.

Another prior art example of the above type of speed control unit is described in U.S. Pat. No. 3,708,240. This known speed governor is located in the rotor shaft and does not really add to the length of the motor. However, this built-in speed governor is still exposed to the risk of contamination, because the air flow to the motor passes right through the speed governor mechanism. Accordingly, foreign particles transported by the air flow passing through the governor may contaminate and cause malfunction of the governor.

In still another prior art device described in U.S. Pat. No. 3,071,115, there are provided both a flyweight operated speed governor and an overspeed safety device, both disposed within the rotor. Also the overspeed safety device is operated by flyweights, and the rotor design as a whole is rather complicated. Due to its location inside the rotor, these mechanisms are protected from dust and other particles transported by the pressure air. However, there are several guide surfaces for the flyweights and the valve element lock pins which after some time of tool operation may be exposed to corrosion or other types of sticking effect. This might jeopardise the intended safety function. Moreover, the fly-weight type safety device actuator is not only complicated but requires a relatively large radial space. Still another drawback with this known type of device is the difficulty to make it operate with very fast rotating rotors, such as turbine wheels. In such applications, the centrifugal forces then acting on the flyweights and other parts are very strong, which puts high demands on for instance the dimensions and material of the flyweight springs.

OBJECT OF THE INVENTION

The primary object of the invention is to provide a speed control unit for a rotation motor wherein the control unit parts do not add to the dimensions of the motor and are well protected from dust and other foreign particles, and wherein the overspeed safety mechanism is structurally simple and reliable in operation, even in high speed applications.

BRIEF DESCRIPTION OF THE DRAWINGS

A preferred embodiment of the invention is below described in detail with reference to the accompanying drawings in which.

DETAILED DESCRIPTION

Figure 1:
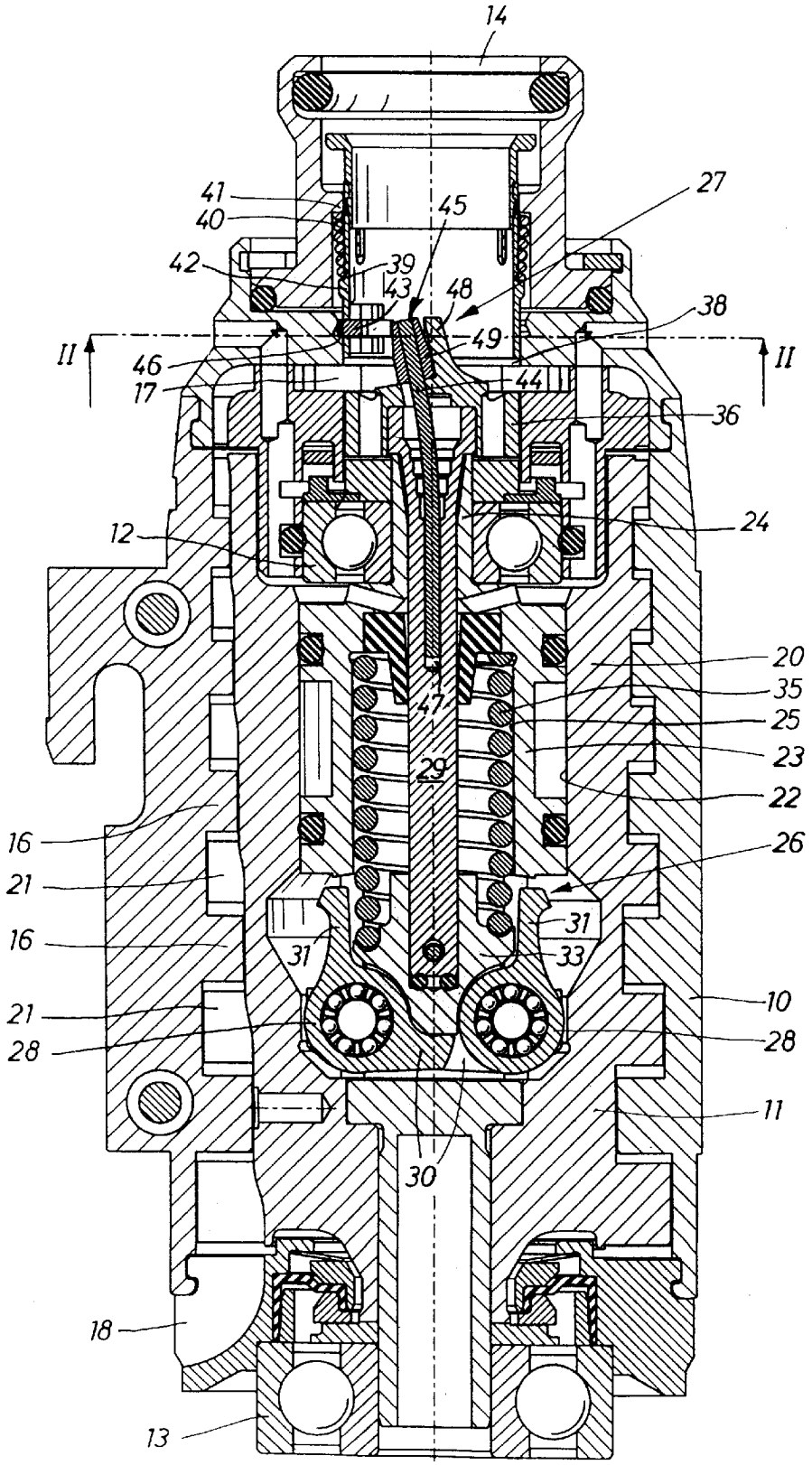
FIG. 1 shows a longitudinal section through a pneumatic motor provided with a speed control unit according to the invention.

The motor shown in FIG. 1 is a six-stage axial type air turbine comprising a stator 10 and a rotor 11. The stator 10 is provided with rotor bearings 12,13, a pressure air inlet passage 14 and six circumferential rows of guide vanes 16. The air inlet passage 14 has a substantially cylindrical shape and is disposed coaxially relative to the rotation axis of the rotor 11. A circumferential lateral opening 17 in the inlet passage 14 communicates pressure air to the guide vanes 16 and further to an outlet opening 18.

The rotor 11 comprises a main body 20 which is provided with six circumferential rows of drive blades 21 disposed in a common way alternatingly between the rows of guide vanes 16 to complete the turbine. The pressure air supplied through the inlet passage 14 and the lateral opening 17 passes the guide vanes 16 and the drive blades 21 to generate a driving torque on the rotor 11.

The rotor 11 is formed with an axially extending cavity or blind bore 22 which is open towards the inlet passage 14. In this bore 22, there is secured a mounting structure 23 which is formed with a coaxial neck portion 24 for carrying one of the rotor bearings 12, and with a coaxial bore 25. This mounting structure 23 forms a support both for a speed governor 26 and an overspeed safety mechanism 27. As usual in motors being provided with such speed control means, the speed governor 26 is active within a certain speed range to regulate the supplied pressure air flow and maximise the motor speed to a certain first level, whereas the overspeed safety mechanism 27 remains completely inactive until a second predetermined higher motor speed level is reached. Then, it will be activated to stop or at least substantially restrict the air inlet flow so as to put the motor out of operation.

The speed governor 26 comprises an elongate valve element 29 extending coaxially through the bore 22 and being biassed by a spring 35 toward an open position. The speed governor 26 also includes two L-shaped fly-weight members 28 each of which is pivotally supported via a roller bearing on the mounting structure 23 and comprises a thrust part 30 and a weighted part 31 movable outwardly by centrifugal action. The fly-weight members 28 act via their thrust parts 30 on an end piece 33 mounted on the rear end of the valve element 29. The end piece 33 also serves as an axial support for the bias spring 35 of the speed governor 26. The end piece 33 is movable in the bore 25 of the mounting structure 23 and forms a rear support for the valve element 29. At its forward end, the valve element 29 is movably guided in the neck portion 24 of the mounting structure 23.

At its forward end, the valve element 29 is formed with a head 36 which is sealingly guided in a bore 38 forming the inlet passage 14. The bore 38 as well as the valve element 29 are coaxially disposed relative to the rotation axis of the rotor 11, and the valve element 29 is arranged to be axially displaced by the fly-weight members 28 such that the valve element head 36 controls the air flow through the lateral opening 17.

The overspeed safety device 27 comprises a flow blocking or flow restricting element 39 which is tubular in shape and movably guided in the inlet passage bore 38. The flow restricting element 39 is shiftable between a rest position, illustrated in FIG. 1, and an active position in which it restrict or blocks the air flow through the lateral opening 17. A coil spring 40 is pretensioned between a shoulder 41 in the stator 10 and a shoulder 42 on the flow restricting element 39 so as to exert a bias force on the flow restricting element 39 toward the active air flow restricting position of the latter.

The flow restricting element 39, however, is locked against displacement by a trip mechanism comprising a trip element 43 supported on the element 39 and a speed responsive actuator 45 co-rotative with the rotor 11. The trip element 43 is pivoted between a lock position in which it engages a shoulder 46 in the bore 38, thereby retaining the element 39 in its rest position. See FIG. 2. A leaf spring 37 carried on the flow restricting element 39 exerts a bias force on the trip element 43 toward the lock position of the latter.

The actuator 45 of the overspeed safety device 27 comprises a piece of elastically deformable spring element 44 which originally is of a linear shape but which is elastically bent to a pretensioned condition at mounting. The spring element 44 is preferably formed of a spring wire which by its one end is inserted and secured in a central bore 47 in the valve element 29. The other end of the spring element 44 extends out of the bore 47 and is bent to rest on a radial support 48 on the valve element head 36. The spring element 44 is not only bent out from the rotation axis but is provided with a tubular weight 49 for increasing the centrifugal action on the actuator 45. The spring element 44 reaches out of the bore 47 long enough to be able to be further elastically bent at the attainment of the predetermined speed limit to, thereby, hit and release the trip element 43.

Figure 2:
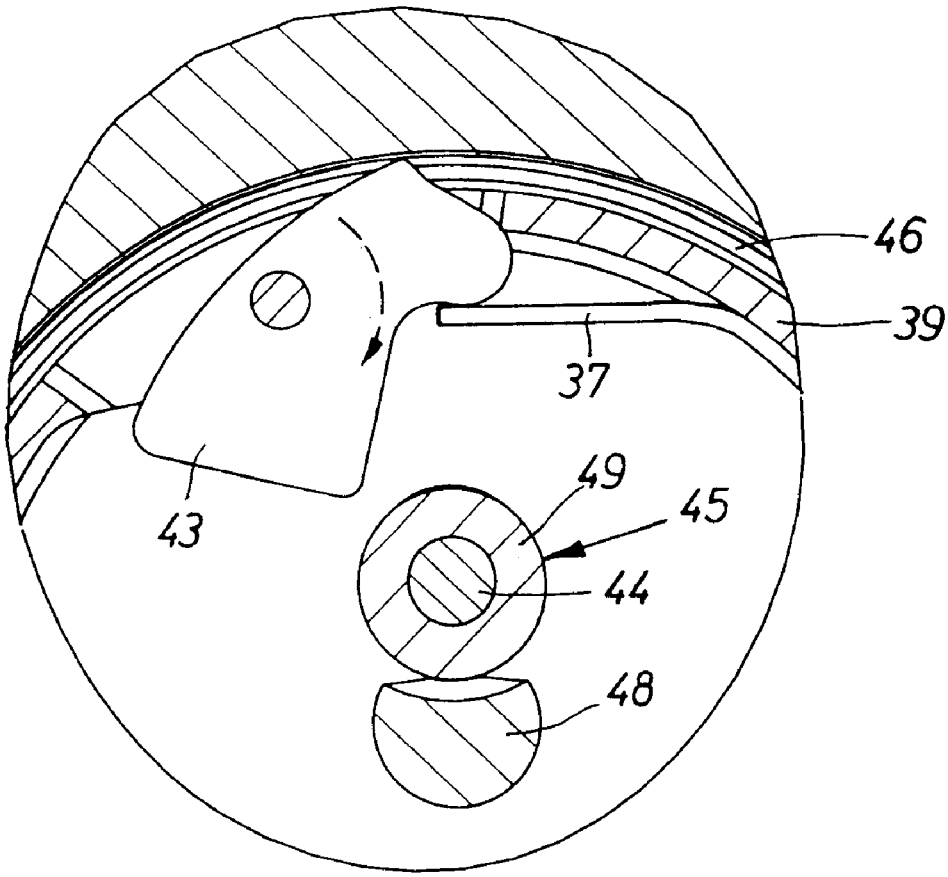
FIG. 2 shows a cross section through the trip mechanism of the overspeed safety device according to the invention.

When hit by the actuator 45, the trip element 43 is pivoted against the action of the leaf spring 37, as illustrated by a dash line arrow in FIG. 2, and is temporarily moved out of engagement with the shoulder 46. Thereby, the flow restricting element 39 is freed for movement towards its air flow blocking position. At normal operation, however, i.e. when the speed governor 26 functions as intended, the spring element 44 remains in its rest position in contact with the support 48 and the trip element 43 remains uneffected in its locking position. See FIG. 2.

If for some reason the speed governor 26 becomes stuck or otherwise malfunctions, resulting in an increased rotor speed, the spring element 44 is bent further outwardly by centrifugal action until the trip element 43 is hit by the tubular weight 49. Thereby, the trip element 43 is released from its engagement with the shoulder 46 and frees the flow restricting element 39 for axial movement towards its active air flow restricting position in which it more or less blocks air flow through the opening 17 and reduces substantially the rotor speed.

The speed control unit according to the invention, as illustrated by the above example, is very compact and yet very simple in design. This makes it suitable for small size fast rotating motor applications, such as air turbine driven power tools. In particular, the overspeed safety device is not only very compact and simple but has a reliable function. The reason is that the actuator 45 has no guide surfaces exposed to friction forces but is shifted by elastic deformation only. The actuator 45 is reliable also in that it has a central location on the rotor 11 which means that the centrifugal forces acting on it are of moderate magnitude only, even at very high speed levels

What is claimed is:

1. A speed control unit for a pneumatic rotation motor having a stator with an air inlet passage, and a rotor journalled in the stator, said speed control unit comprising:

a speed governor including at least two flyweight members, a bias spring, and a valve element displaceable by said flyweight members against said bias spring to restrict air flow through said inlet passage of said stator of said pneumatic rotation motor at motor operation speeds above a predetermined first speed level; and an overspeed safety device including a flow restricting element which is movably supported in said stator of said pneumatic rotation motor and which is shiftable between a rest position and an active flow restricting position, a spring which biases said flow restricting element toward said active position, a trip element which normally locks said flow restricting element in said rest position, and a speed responsive actuator which is co-rotative with said rotor and which is arranged to release said trip element and free said flow restricting element for movement toward said active position at motor operation speeds above a second predetermined motor speed level;

wherein said rotor of said pneumatic rotation motor comprises a coaxial blind bore having an open end facing said air inlet passage and in which a mounting structure is provided for movably supporting said flyweight members, said bias spring, and said valve element within said bore;

wherein said valve element comprises an air flow controlling head located outside said bore; and wherein said speed responsive actuator comprises an elongate spring element having a first end secured in a coaxial bore in said valve element and having a second end extending out of said valve element, with said elongate spring element being radially supported in an elastically bent shape and being arranged to be exposed to centrifugal action such that when said pneumatic rotation motor attains said second predetermined motor speed level said elongate spring element is further bent by the centrifugal action and said second end of said elongate spring element hits and releases said trip element.

2. The speed control unit according to claim 1, wherein:

said flow restricting element is tubular in shape and axially movable in said air inlet passage of said stator of said pneumatic rotation motor; and said trip element is supported on said flow restricting element and is arranged to co-operate with a shoulder on said stator for locking said flow restricting element in said rest position.

3. The speed control unit according to claim 2, wherein said elongate spring element carries a weighted member at said second end thereof so as to increase the further bending of said elongate spring element in response to the centrifugal action.

4. The speed control unit according to claim 3, wherein said elongate spring element comprises a piece of wire which was originally of a linear shape but which has been elastically bent to a pre-tensioned condition when mounted in said coaxial bore of said valve element.

5. The speed control unit according to claim 4, wherein:

said air inlet passage of said stator of said pneumatic rotation motor comprises a bore disposed coaxially with said valve element and having at least one lateral air feed opening; and both said valve element and said flow restricting element are tubular in shape and axially displaceable in said bore to control air flow through said at least one lateral feed opening.

6. The speed control unit according to claim 5, wherein said valve element comprises a rear end piece, and said at least two flyweight members are located at an inner end of said blind bore of said rotor and arranged to exert a valve element shifting force on said end piece.

7. The speed control unit according to claim 1, wherein said elongate spring element carries a weighted member at said second end thereof so as to increase the further bending of said elongate spring element in response to the centrifugal action.

8. The speed control unit according to claim 1, wherein said elongate spring element comprises a piece of wire which was originally of a linear shape but which has been elastically bent to a pre-tensioned condition when mounted in said coaxial bore of said valve element.

9. The speed control unit according to claim 1, wherein:

said air inlet passage of said stator of said pneumatic rotation motor comprises a bore disposed coaxially with said valve element and having at least one lateral air feed opening; and both said valve element and said flow restricting element are tubular in shape and axially displaceable in said bore to control air flow through said at least one lateral feed opening.

10. The speed control unit according to claim 1, wherein said valve element comprises a rear end piece, and said at least two flyweight members are located at an inner end of said blind bore of said rotor and arranged to exert a valve element shifting force on said end piece.

11. An overspeed safety device for a pneumatic rotation motor having a rotor and a stator with an air inlet opening, said overspeed safety device comprising:

a flow restricting element which is movably supported in said stator of said pneumatic rotation motor and which is shiftable between an inactive rest position and an active position in which said flow restricting element at least partly covers said inlet opening;

a spring which biases said flow restricting element toward said active position;

a trip element which normally locks said flow restricting element in said rest position; and a speed responsive actuator which is co-rotative with said rotor and which is arranged to release said trip element and free said flow restricting element for displacement toward said active position at motor operation speeds above a second predetermined motor speed level;

wherein said speed responsive actuator comprises an elongate spring element having a first end secured in a coaxial relationship with said rotor of said pneumatic rotation motor, and a second end extending out of said rotor in a substantially axial direction; and wherein said elongate spring element is arranged to be elastically bent in a radial direction by centrifugal forces acting on said second end of said elongate spring element such that when said pneumatic rotation motor attains said second predetermined motor speed level said second end of said elongate spring element hits and releases said trip element.

12. The overspeed safety device according to claim 11, wherein said second end of said elongate spring element is supported on said rotor of said pneumatic rotation motor in an initially bent shape so as to be exposed to centrifugal action and to be further bent to a trip element hitting and releasing position when said pneumatic rotation motor attains said second predetermined motor speed level.

13. The overspeed safety device according to claim 12, wherein said elongate spring element comprises a piece of spring wire.

14. The overspeed safety device according to claim 13, wherein said elongate spring element is provided with a weighted member for increasing the centrifugal force acting on said spring element.

15. The overspeed safety device according to claim 11, wherein said elongate spring element comprises a piece of spring wire.

16. The overspeed safety device according to claim 15, wherein said elongate spring element is provided with a weighted member for increasing the centrifugal force acting on said spring element.

* * * * *

UNITED STATES PATENT AND TRADEMARK OFFICE

CERTIFICATE OF CORRECTION

PATENT NO. : 6,179,552 B1
DATED : January 30, 2001
INVENTOR(S) : Rolf Alexis Jacobsson It is certified that error appears in the above-identified patent and that said Letters Patent is hereby corrected as shown below:

Title page,
Item [45], Date of Patent, delete "*";
Delete Item "[*] Notice,
"This patent issued on a continued prosecution application filed under 37 CFR 1.53 (d), and is subject to the twenty year patent term provisions of 35 U.S.C. 1.54 (a) (2)."

Signed and Sealed this

Ninth Day of March, 2004

JON W. DUDAS
*Acting Director of the United States Patent and Trademark Office*